United States Patent [19]

Savage

[11] Patent Number: 4,522,043

[45] Date of Patent: Jun. 11, 1985

[54] KNITTING MACHINE USING COMBINATION PRESSER RAISING WHEEL

[75] Inventor: William E. Savage, Manlius, N.Y.

[73] Assignee: Tompkins Bros. Co. Inc., Syracuse, N.Y.

[21] Appl. No.: 443,230

[22] Filed: Nov. 22, 1982

[51] Int. Cl.[3] ..... D04B 13/00; D04B 15/28; D04B 35/00

[52] U.S. Cl. ..... 66/80; 66/98; 66/113

[58] Field of Search ..... 66/80, 103, 105, 113, 66/98

[56] References Cited

U.S. PATENT DOCUMENTS

| | | | |
|---|---|---|---|
| 160,685 | 3/1875 | Kent et al. | 66/80 |
| 168,983 | 10/1875 | Gormly | 66/113 |
| 240,008 | 4/1881 | Conde | 66/103 |
| 296,210 | 4/1884 | Osborne | 66/80 |
| 488,019 | 12/1892 | Lieb | 66/103 X |
| 776,588 | 12/1904 | Gormly | 66/103 X |
| 840,828 | 1/1907 | Demers | 66/113 X |
| 976,867 | 11/1910 | Gormly | 66/113 |
| 2,286,469 | 6/1942 | Crommie | 66/133 |

FOREIGN PATENT DOCUMENTS

| | | | |
|---|---|---|---|
| 36182 | 7/1886 | Fed. Rep. of Germany | 66/105 |
| 66312 | 12/1892 | Fed. Rep. of Germany | 66/103 |
| 239572 | 9/1925 | United Kingdom | 66/80 |
| 241438 | 10/1925 | United Kingdom | 66/80 |

*Primary Examiner*—Wm. Carter Reynolds
*Attorney, Agent, or Firm*—Bruns and Wall

[57] ABSTRACT

Apparatus for use in a spring needle circular knitting machine utilizing a lay-in concept wherein one or more strands of lay-in yarn are combined with tie yarn and stitch yarn to create a limitless number of fabric surface effects. A combination tie presser and lay-in raising wheel is placed in close face to face relationship in each feed station with a tie stitch sinker burr. The combination presser and raising wheel has a camming surface that acts in concert with blade elements that mesh with the needles of the rotating needle cylinder. The camming surface closes the beards of the needles over the tie stitch yarn almost immediately after the sinker burr has inserted the tie yarn thereunder and holds the beards closed as the blades of the wheel raise the lay-in yarn over the closed beards. The camming surface then releases the beards allowing them to spring open to land the lay-in yarn over the tips of the needles. The apparatus enables the lay-in yarn to be raised or landed over the yarn in the smallest space possible thus compacting the length of a feed set and resulting in a high production rate and capacity for a given machine. Furthermore, because of the immediate closure action provided by the combination presser and raising wheel, the yarn is precluded from moving out of the beards before the lay-in yarn is landed.

3 Claims, 5 Drawing Figures

KNITTING MACHINE USING COMBINATION PRESSER RAISING WHEEL

BACKGROUND OF THE INVENTION

The present invention relates to the improvement of spring needle circular knitting machines utilizing a lay-in concept and, in particular, to an improved construction for clearing lay-in yarn over tie yarn within each feed section of the machine.

Spring needle knitting machines are well known in the art. These machines have enjoyed great longevity because of their rugged construction and their ability to produce any number of fabric constructions such as fleece, terry, plush, pile and the like using what is generally referred to as the "lay-in concept". This concept basically involves bringing together or knitting one or more lay-in yarns with a tie or binder yarn and a stitch yarn. This concept is embodied in machines of the general type manufactured by Tompkins Brothers Co., Inc., Syracuse, N.Y. and illustrated in U.S. Pat. No. 475,058 to Hill and U.S. Pat. No. 1,805,339 to McAdams and the disclosure in these patents may be considered as being incorporated herein by reference for background purposes.

In the spring needle machine, a cylinder of vertically disposed, equally spaced needles are rotated past one or more feed stations that are capable of adding a complete course of yarn to the fabric. Normally, a number of feed stations are positioned about the needle cylinder so that several courses can be added to the fabric during each complete revolution of the cylinder. As can be seen, if the circumferential length of each feed station can be compressed or reduced, more stations can be added to the machine thus increasing its productivity.

Ordinarily, after the lay-in yarn has been placed in front and behind the shanks of the needles and cleared downwardly, tie yarn is looped underneath the open beards of the needle. The beards are then closed using either a stationary, horizontally aligned bar or a presser wheel of the type disclosed by Logan in U.S. Pat. No. 2,187,132. After closure, the lay-in yarn is raised by means of an independent lander burr over the closed needles to intertwine the two yarns. As should be evident, the sinker burr, the presser device and the lander burr, all being separately mounted in the feed station, utilize a relatively large amount of the overall feed length. By the same token, because all the elements are separately mounted, they each must be accurately positioned and secured in relation to each other to insure that the course is properly knitted. Any misalignment or movement of an element within the feed will result in the production of unusable fabric. For instance, if the presser device does not close the beards almost immediately after the tie loop is introduced thereunder, the tie yarn can fall out of the beards before the lay-in yarn is landed thus placing a defect in the fabric.

In U.S. Pat. No. 2,286,469 to Crommie, there is disclosed a feed station for use in a circular knitting machine having a combined beard closing disc and stitch cast-off wheel that are mounted upon a single spindle. The device basically includes a conventional bladed cast-off wheel and a flat faced washer that is held against the upstream end face of the cast-off wheel. The outer periphery of the washer is generally perpendicular to its flat end face. Accordingly, when the periphery of the washer is rotated with the bladed wheel across the beards of the needles, the beards are only held closed for an extremely short period of time. The opening and closing action of the washer is sometimes completed before the bladed wheel has a chance to contact the previously formed stitch. As a consequence, the beards are opened or partially opened as the yarn begins to move thereover. It has also been found that the flat contoured washer arrangement produces a less than smooth beard closing action and can overstress the beards thus leading to early failure of the needles.

As noted, in the Crommie device the beard closing washer is mounted upon the same spindle as the cast-off wheel. The washer is held to the spindle by a nut that is threaded onto the end of the spindle. The nut protrudes a considerable distance out from the end face of the washer and thus does not permit the adjacent feed element to be mounted in close proximity therewith. Consequently, whatever space advantage that might have been gained by mounting the beard closing washer upon the same spindle can very well be lost because of the bulky mounting structure. This, combined with the inability to coordinate the activity of the beard closing washer with that of the cast-off wheel, has resulted in the washer type combination not finding widespread use in the industry.

SUMMARY OF THE INVENTION

It is therefore an object of the present invention to improve spring needle circular knitting machines.

A still further object of the present invention is to improve apparatus for landing lay-in yarn over tie yarn in a spring needle machine.

Another object of the present invention is to reduce the circumferential length required by a feed station for adding a course to a knitted fabric produced on a circular spring needle machine.

Yet another object of the present invention is to insure that lay-in yarn is landed over the tie yarn of a fabric as it is being knitted on a spring needle circular knitting machine to avoid defects being produced in the fabric.

These and other objects of the present invention are attained by means of a combination presser and raising wheel positioned in a feed station of a spring needle circular knitting machine in face-to-face relationship with a tie yarn sinker burr. The combination wheel consists of a circular flange rotatably mounted in the feed having canted blade elements radially extending from the outer periphery thereof that are adapted to mesh between adjacent needles on the needle cylinder to turn the wheel and raise lay-in yarn previously placed to the front and back of the needles. The outer periphery of the wheel flange contains an axially disposed camming surface which moves in contact with the needles' beards to close the beards immediately upon the tie yarn being inserted thereunder and holding the beard closed while the wheel blades lift the lay-in yarn over the beards. After the lay-in yarn is landed, the camming surface releases the beard.

BRIEF DESCRIPTION OF THE DRAWINGS

For a better understanding of these and other objects of the present invention, reference is had to the following detailed description of the present invention which is to be read in conjunction with the accompanying drawings, wherein.

DESCRIPTION OF THE INVENTION

Figure 1:
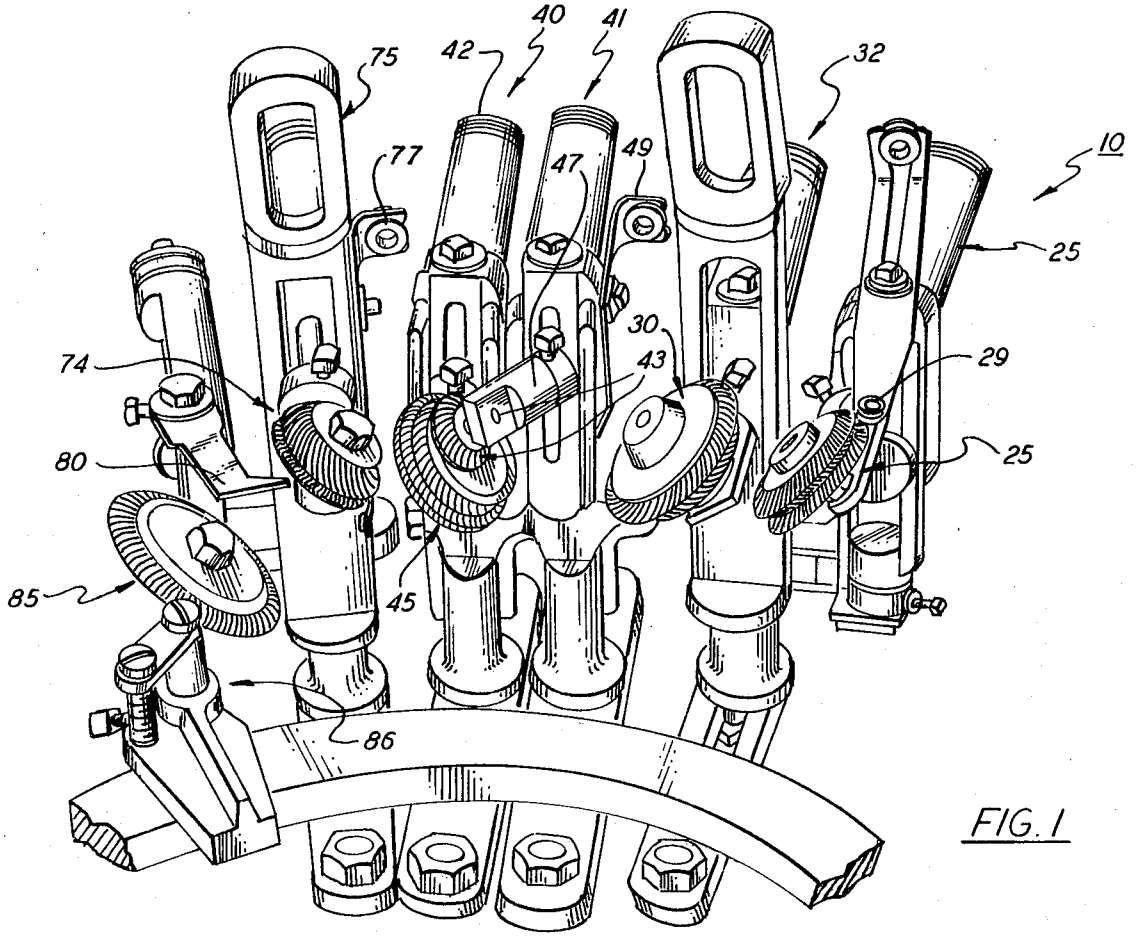
FIG. 1 is a perspective view of a feed station looking from the inside of the needle cylinder at a feed station embodying the teachings of the present invention.

Referring now to the drawings, a feed station embodying the teachings of the present invention is illustrated at 10. Although not shown, the feed station is contained within a spring needle circular knitting machine of the type previously noted in regard to the disclosures contained in U.S. Patents to Hill and McAdams wherein a needle cylinder 11 is rotated past one or more feed stations. Conventionally, the needle cylinder 11 includes an annular ring of lead blocks 13—13 (FIG. 2) each of which supports a pair of beard type needles 12 in a vertical or upright position. The needles contain an elongated shank 14 that is turned back upon itself to form a beard loop 15. The needles are formed of a spring-like material that allows both the shank and the beard to be resiliently displaced during the knitting operation. The beard is normally held in an open condition away from the shank to allow yarn to enter the loop. The beard may be closed by resiliently pressing it inwardly against the shank to temporarily capture the yarn therein and thus enable previously knitted loops or laid in yarn to be raised or landed over the top of the needles. The needle construction and the method of closing the beards to permit landing are old and well known in the art.

In practice, the needle cylinder rotates continually about the vertical axis of the machine carrying with it a tube of fabric as it is being knitted. The fabric, as it is being manufactured, is taken up by means of a take up roll (not shown) which is arranged to turn in synchronization with the needle cylinder. At locations about the periphery of the cylinder, supply spools of yarn are positioned for delivering continuous strands of yarn to the feed stations. As will be explained in greater detail below, the yarn is drawn from the supply spools and brought into the needles to construct a new course on the fabric.

Figure 2:
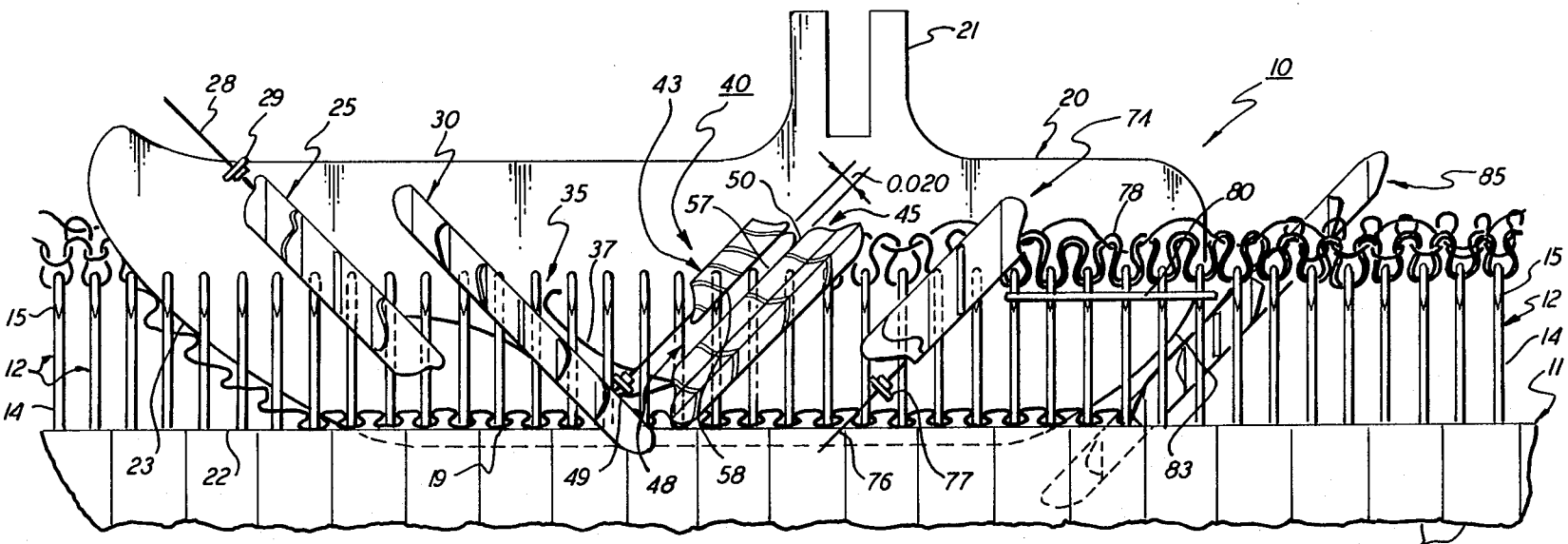
FIG. 2 is a simplified schematic elevation showing a feed section constructed in accordance with the present invention for producing a double plush fleece fabric using the lay-in concept.

As previously noted, the spring needle circular machine is well suited to manufacturing a large number of different fabrics. The present invention will be explained in reference to a machine having a plurality of feed stations positioned about the needle cylinder for producing a double plush fleece. As the previously knitted fabric is carried toward the feed station by the needle cylinder, the last knitted course, which is depicted as 19 in FIG. 2, is secured under the open beards of the needles by means of the fabric take up mechanism which maintains a slight amount of upward tension on the fabric. A cloth shoe 20, which is secured to the machine frame by a mounting neck 21, is placed inside the needles to contact the fabric as it enters the feed station. The bottom edge of the shoe is situated at or slightly below the top shoulder 22 of the leads 16. The front edge 23 of the shoe which first contacts the fabric is inclined upwardly in the upstream direction to direct the engaged fabric downwardly along the shank of the needles to the level or just below the top of the leads. This places the fabric well below the beards and thus permits a new course to be knitted over the last knitted course without difficulty.

As noted, fabrics manufactured on a circular spring needle machine involve the knitting of at least one lay-in yarn with a tie yarn and a stitch yarn. In the case of a double plush fleece fabric, only one lay-in yarn is needed to complete the fabric. A lay-in burr 25 is mounted in the feed immediately downstream from the leading edge of the cloth shoe. The burr is of the same general construction described by Tompkins in U.S. Pat. No. 680,552. The burr is mounted outside the needle cylinder and is angularly disposed upon a lay-in tube assembly 25 in respect to the cylinder so that the blades of the burr move lay-in yarn 28 fed through a guide 29 downwardly over the top of the needles. Needle displacing blocks are mounted between the blades of the burr at every third space which pushes back every third needle coming into mesh with the blades. Accordingly, the burr passes lay-in yarn behind three needles, in front of the fourth and behind the next three and so on to wrap yarn about the needles in a predetermined pattern about the needles.

After the lay-in yarn has been placed upon the needles it is moved downwardly on the shanks by use of a clearing burr 30. The clearing burr is constructed similar to the lay-in burr and is carried outside the needle circle by a clearing tube assembly 32. The burr contains a series of blades that mesh with the needles in a conventional manner. The blades encounter the lay-in yarn, or because of the positioning of the blades on the burr, serve to push the yarn downwardly along the needle shank to a level well below the beards but yet above the top of the fabric being held against the lead shoulders by the cloth shoe.

A retaining spring 35 may be secured to the cloth shoe or stationary machine frame which includes an elongated resilient leg 37 that is biased against the back of the needle shanks downstream of the clearing burr. Cleared lay-in yarn passes under the spring and thus insures that the yarn will remain at the cleared level as the cylinder advances to the next yarn introduction position.

In the area above the retaining spring there is mounted a tie unit generally referenced 40 for bringing the lay-in yarn together with the tie yarn to form an integral part of the knitted course. The tie unit 40 includes a tie sinker burr 43 and a combination presser and raising wheel 45. As best illustrated in FIG. 2, the sinker burr and the combination wheel are rotatably mounted on sinker tube assembly 41 and wheel tube assembly 42, respectively, with the two end faces mounted in assembly in close overlying relation so that the spacing therebetween is about 0.020 of an inch or less. The sinker burr is of conventional design and is mounted for rotation about axis 47 that is inclined upwardly in an upstream direction. The yarn 48 is drawn from a spool (not shown) through a yarn guide 49 and is passed into the sinker burr. The burr carries the tie yarn upwardly underneath the open burrs of the adjacent needles as they are transported past the burr. The blades of the burr are contoured so that they project the tie yarn in a loop 50 that is loosely engaged by the open beard.

It is important at this point to quickly close the beards to capture the tie loop in the needles before they can fall out of or be otherwise dislodged from the beards. The combination presser and raising wheel is arranged to move in contact with the beards to immediately effect closure thereof before the tie yarn loops can be disturbed.

Figure 4:
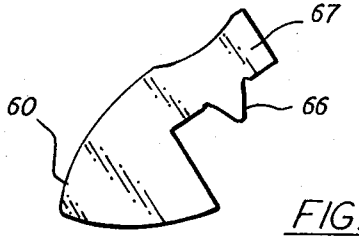
FIG. 4 is an enlarged side view of one of the blade elements utilized in the wheel illustrated in FIG. 3.
Figure 3:
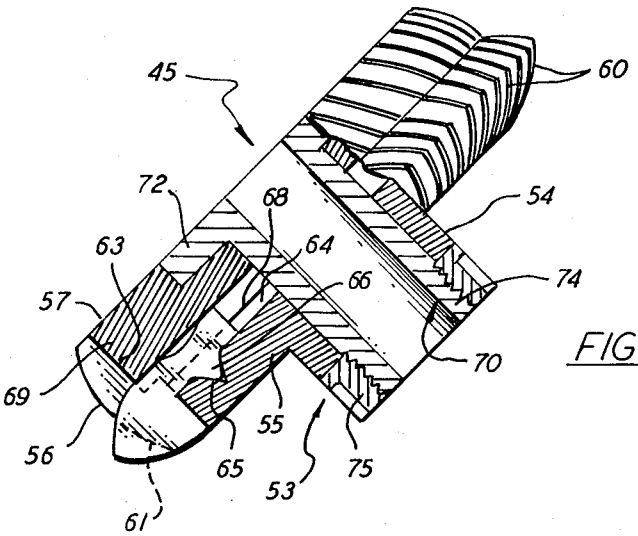
FIG. 3 is an enlarged elevation in partial section showing the construction of the combination presser and raising wheel of the present invention.

The combination presser and raising wheel is shown in greater detail in FIGS. 3 and 4. The wheel contains a main body section 53 having a cylindrical hub 54 and a radially extended cylindrical flange 55 depending from the hub. The outer peripheral surface of the flange is contoured to provide an arcuate shaped cam 56 that controls the opening and closing of the beards after the tie yarn loops are inserted thereunder. The end face 57 of the combination wheel is a flat surface that is placed adjacent to the flat end face 58 of the tie sinker burr so that the camming surface of the combination wheel moves immediately into contact with the beards as the tie loops are formed. The camming surface contains three action zones which extend in series from the end face 57 back axially towards the hub 54. The first zone is contoured to initially close the beards of the contacted needles. The second zone is profiled to hold the beards closed for a sufficient period of time to permit the lay-in yarn to be raised over the closed lower entrance of the beard. The last or third zone is profiled to release the beards under controlled conditions whereupon the beards spring open after the lay-in yarn is landed.

A series of blade elements 60—60 are equally spaced about the periphery of the flange so that the blades mesh between adjacent needles on the needle cylinder to rotate the wheel at cylinder speed. The blade elements are slidably received in oblique slots 61 cut into the flange of the body. The slots pass into a cylindrical blind hole 63 that is passed inwardly from the end face 57 of the body and which terminate at wall 64. A circular V-shaped groove 65 is formed in the wall 64 that receives a complimentary rib 66 provided on each blade which prevents radial movement of the blades in assembly. The blades are passed through the slots and the reduced arm 67 of each blade is passed into a slotted washer 68 which serves to circumferentially align the blades in assembly.

The wheel is closed by placing a retaining ring 69 into the blind hole 63 that bottoms against the aligned blade elements. A tee bushing 70 is then passed through the control opening in the body section with the expanded head 72 of the bushing seated securely in a countersunk hole provided in the bushing. The end 74 of the bushing protrudes beyond the end face of the hub and is threaded to accept a nut 75 that serves to lock the component parts of the wheel in closure.

The blades 60 of the combination wheel are axially positioned in the second and the third camming zones only. Accordingly, the blades will not engage the lay-in yarn until such time as the adjacent beards have been completely closed. It must be further noted that because the camming surface extends axially between the blade elements, the beards are held closed by the wheel while the blades are lifting the lay-in yarn over the needles. The beards remain closed until the lay-in yarn passes over the closed entrance of the beard and is carried over the needle as the beard is reopened during its passage through the third camming zone. As can be seen, the entire tie-in insertion and lay-in landing operation is positively controlled without interruption from the start of the operation to its finish. Furthermore, the component parts required to carry out the operation are located in the feed within a minimum amount of space. Accordingly, a considerable amount of space is saved per feed and more feed per machine can be utilized resulting in higher production.

A second stitch sinker burr 74 is positioned downstream from the combination presser and raising wheel and is mounted for rotation in the sinker tube assembly 75. The second sinker burr loops a facing yarn 76 fed from guide 77 under the now opened beards of the needles. In accordance with known principles, the stitch sinker burr forms a second set of loops 78 on each adjacent needle. The insertion of the stitch yarn completes the yarn addition for the fabric within the feed and it now remains to cast the fabric over the loops being held under the beards.

A bar presser 80 is located downstream from the second sinker burr which is secured to a presser tube assembly 81. The bar is brought into contact with the beards and closes the beards over both the tie yarn and stitch yarn loops preparatory to casting off.

The cloth shoe terminates with an upwardly slanted surface 83 that moves upwardly past the downstream end of the presser bar. The surface 83 permits the fabric, which as noted above, is under a slight tension to be drawn upwardly along the shank of the needles toward the closed beards. The fabric is allowed to pass over the closed beards and then comes under the influence of a combination lander and cast off burr 85. The combination burr is rotatably mounted inside the needle cylinder on a support post assembly 86 and functions in a conventional manner to engage the previously knitted fabric tube and advance it upwardly over the tips of the needles and cast the previously knitted loops off the needles thus completing a new course of stitching. The just formed set of loops remains attached to the needle beards and now constitutes the last knitted course.

Significant to the invention is the capturing of the tie stitch yarn in the beards and the immediate closing of the beards and landing of lay-in yarn over the needles in a minimum amount of space. In addition, the present apparatus carries out the stitching and lay-in yarn landing operation in a positive manner under the control of a regulating cam which prevents overstressing of the needles while at the same time delivering an uninterrupted programmed motion to the needles.

Figure 5:
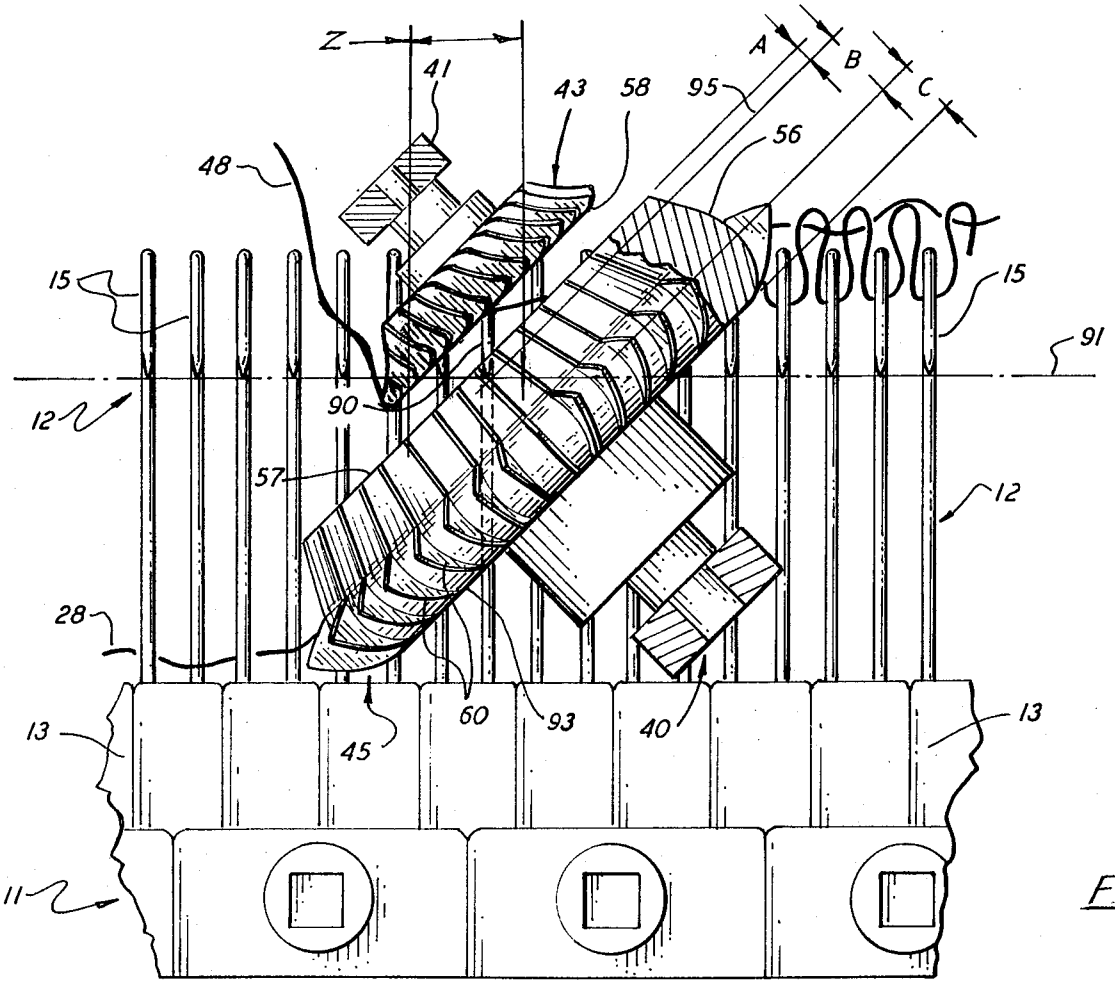
FIG. 5 is an enlarged side view showing the combination pressure and raising wheel in association with a sinker burr viewed from outside the needle circle.

With reference to FIG. 5, there is shown in greater detail the sinker burr 43 and the combination presser and raising wheel 45 that embody the present invention. As is well-known in the art, the sinker burr blades are presented in meshing engagement to the moving needle circle to thread tie yarn 48 under the beards 15 of the needles. The blades carry the tie yarn upwardly well into the open beards before the yarn is released. The yarn threading region in which the blades mesh with the needles is depicted as region Z in FIG. 5 and extends circumferentially along the needle circle for some predetermined distance depending upon the size of the burr. A needle 90 is shown centered within this yarn threading region. The burr is further arranged so that the angularly disposed bottom face of the burr clears the beard entrance which is depicted at line 91 within this region. This, in turn, provides access to the beard entrance during the period that the burr blades are physically holding the tie yarn within the beard eye. The camming surface 56 of the wheel 45 is brought into closing contact with the needle beards in this region as soon as the burr clears the entrance. The three previously noted cam profiles span the periphery of the wheel between the top surface 57 and bottom surface 93 of the wheel. Within camming zone A, the entrance of the contacted beard is brought at a controlled rate to a fully closed position. Closure occurs at line 95 separating zones A and B. The cam B passes between the landing blades 60 and serves to hold the beards closed as the lay-in yarn is landed over the beard entrances. Finally, the beards are reopened at a controlled rate in zone C and the lay-in yarn is cast off the needles.

While this invention has been described with reference to the details as set forth above, it is not limited to the specific structure as disclosed and the invention is intended to cover any modifications or changes as may come within the scope of the following claims.

I claim:

1. In a circular knitting machine having a rotating needle cylinder carrying vertically aligned spring beard needles, apparatus for bringing together a lay-in yarn that passes about the shanks of the needles and a tie yarn which includes a sinker burr angularly disposed outside the needle circle having blades that mesh with the rotating needles within a yarn threading region, said blades being arranged to pass tie yarn upwardly into open beards moving into the threading region, said burr further including a flat bottom surface that is inclined upwardly to clear the entrance of beards positioned within the threading region, a pressing wheel having a top surface spaced apart axially from a bottom surface, said pressing wheel being angularly disposed outside the needle circle with the top surface positioned directly beneath the sinker burr, said wheel having a profiled camming surface that extends continuously across the wheel between the top and bottom surfaces which rides in contact with the cleared beards situated in the threading region to close the entrance of each beard prior to the tie-yarn being released by the sinker burr blades to prevent the tie-yarn from falling out of the beards, a series of landing blades radially extended from the profiled camming surface of the wheel so that the continuously extended camming surface passes between the blades, said blades meshing with the needles to land lay-in yarn over the closed beard entrances and to cast said lay-in yarn off the needles.

2. The apparatus of claim 1 wherein the camming surface includes a first camming zone adjacent to the top surface of the wheel that is profiled to engage the cleared beards of the needles and move the beards to a fully closed position over the tie yarn, and a second camming zone adjacent the first for holding the beards fully closed for a predetermined period of time, said landing blade being mounted on the wheel so that the blades extend axially from the bottom surface of the wheel into the said second zone whereby the lay-in yarn is landed over the fully closed beards.

3. The apparatus of claim 2 that further includes a third camming zone adjacent the second that is arranged to bring the closed beards to an open position at a controlled rate after the lay-in yarn is landed over the said beards.

* * * * *